US011525304B2

(12) United States Patent
Gian

(10) Patent No.: US 11,525,304 B2
(45) Date of Patent: Dec. 13, 2022

(54) TELESCOPING STEP LADDER SAFETY HAND RAILS AND BEAM

(71) Applicant: John Gian, Calgary (CA)

(72) Inventor: John Gian, Calgary (CA)

( * ) Notice: Subject to any disclaimer, the term of this patent is extended or adjusted under 35 U.S.C. 154(b) by 159 days.

(21) Appl. No.: 16/560,070

(22) Filed: Sep. 4, 2019

(65) Prior Publication Data

US 2020/0123855 A1 Apr. 23, 2020

(30) Foreign Application Priority Data

Oct. 22, 2018 (CA) ..... CA 3021758

(51) Int. Cl.
*E06C 7/18* (2006.01)
*E06C 7/14* (2006.01)

(52) U.S. Cl.
CPC ..... *E06C 7/183* (2013.01); *E06C 7/14* (2013.01)

(58) Field of Classification Search
CPC ..... E06C 7/183; E06C 7/14
See application file for complete search history.

(56) References Cited

U.S. PATENT DOCUMENTS

| | | | | |
|---|---|---|---|---|
| 2,614,744 | A * | 10/1952 | Hedglon | E06C 7/16 182/106 |
| 7,383,920 | B2 * | 6/2008 | Meeker | E06C 1/387 182/106 |
| 9,309,718 | B1 * | 4/2016 | Matthew | E06C 7/182 |
| 2015/0014094 | A1 * | 1/2015 | Brooks | E06C 7/14 182/129 |
| 2020/0115959 | A1 * | 4/2020 | Cohen | E06C 7/186 |
| 2020/0248507 | A1 * | 8/2020 | Moss | E06C 1/08 |

FOREIGN PATENT DOCUMENTS

| | | | | |
|---|---|---|---|---|
| DE | 2950742 | A1 * | 6/1981 | F16B 7/0413 |
| DE | 202017000453 | U1 * | 2/2017 | E06C 1/387 |
| EP | 2141306 | A1 * | 1/2010 | E04G 7/22 |

* cited by examiner

*Primary Examiner* — Johnnie A. Shablack

(57) ABSTRACT

A telescoping safety hand rail and beam for step ladders. The invention consists of two upright telescopic rails and a telescopic horizontal beam and tray. The tray includes a container, various pass-through openings for holding tools, a paint can hook and a pass through orifice to accept the horizontal beams to allow telescopic movement. The inner rails extend upwards from the fixed outer rails and latch in place at the top and middle of the telescoping travel range. This advantageously allows the utilization of all steps of a ladder by providing a supplemental knee brace and eliminates the dangerous opportunity to stand unbraced on any step of a ladder. The invention is mounted to a step ladder with strategically placed brackets and double sided mounting tape.

16 Claims, 4 Drawing Sheets

Fig. 3
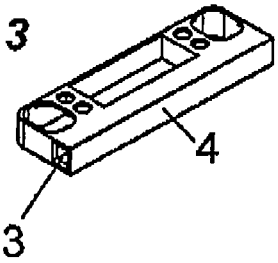
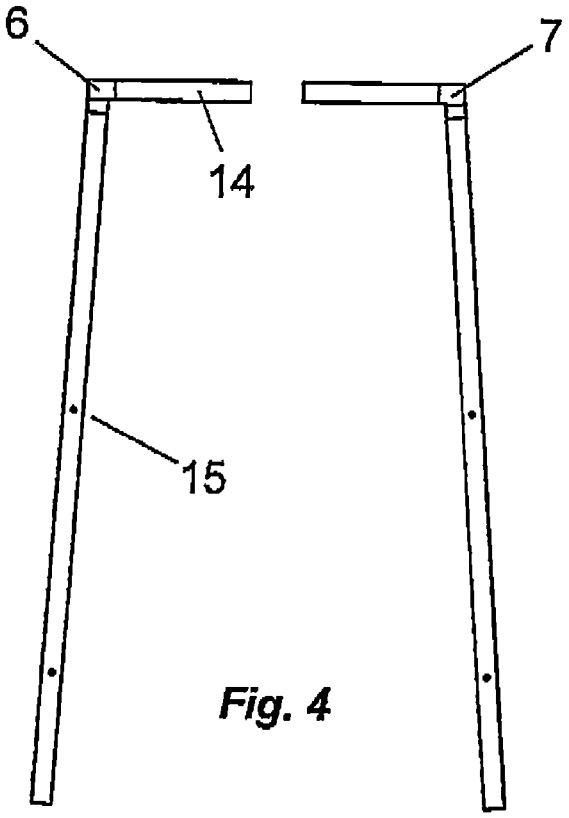
Fig. 4

TELESCOPING STEP LADDER SAFETY HAND RAILS AND BEAM

CROSS-REFERENCE TO RELATED APPLICATIONS

Granted and issued Canadian Patent—CA3021758.

(A) STATEMENT REGARDING FEDERALLY SPONSORED RESEARCH OR DEVELOPMENT

Not Applicable.

(B) THE NAMES OF THE PARTIES TO A JOINT RESEARCH AGREEMENT

Not Applicable.

(C) INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB

Not Applicable.

(D) STATEMENT REGARDING PRIOR DISCLOSURES BY THE INVENTOR OR A JOINT INVENTOR

Not Applicable.

(E) BACKGROUND OF THE INVENTION

(1) Field of the Invention

This invention relates to ladder safety devices, more particularly to telescoping hand rails and beam with a tray for holding tools and the like for use on step ladders, providing supplemental user balance support and access to tools.

(2) Description of Related Art Including Information Disclosed Under 37 CFR 1.97 and 1.98

An attempt at providing height adjustability of a utility shelf for step ladders is disclosed in U.S. Pat. No. 5,740,883 with an expired status to Trank. The device disclosed is a height adjustable ladder tool accessory box for holding tools, hardware, supplies, paint containers, and the like. The tool accessory box is attached to a ladder using wedged shaped mounting brackets, these place the elongated support members parallel to each other. Trank's tool accessory box is designed with a thin slotted shelf tool holder on the front, where if one were to brace against, would not be practical. Trank's mounting instructions includes passing fasteners through plurality of apertures on the mounting brackets. This will void any ladders warranty and structural integrity, deeming it unusable.

An attempt at providing height adjustability of a utility shelf for step ladders is disclosed in U.S. Pat. No. 5,544,718 with an expired status to Schumacher. The device is attached to a step ladder by two retraction tubes which are each mounted on the steps of the ladder. The device attaches to the steps of a step ladder thereby reducing the available area for the user to stand. The extending tubes may interfere with the individual's footing while on the ladder, and therefore introduces additional risk for anyone using a ladder equipped with the device. The horizontal release bar for the spring loaded clamps appear to be located at the top rung, this would make using the top rung and plate inaccessible. Schumacher's tray consists of one compartment. Schumacher's mounting instructions included using screws, this will void any ladders warranty and structural integrity, deeming it unusable.

An attempt at providing an accessory holder ladders is disclosed in U.S. Pat. No. 20150014094 with an abandoned status to Brooks. The device disclosed is a non-height adjustable ladder accessory holder. The accessory box is attached to a ladder using a fixed 3 sided box with closeable hinged side. This 1 feel is not universal due to the fact that the dimensions of side rail on ladders vary from manufactures and differ even more between aluminum and fiberglass ladders. Brooks' accessory holder only has one extension and is not practical as a handrail or brace.

An attempt at providing height adjustability of a utility shelf for step ladders is disclosed in U.S. Pat. No. 2614744-A within expired status to Mead. The device attaches to the side rail and cap of a step ladder using brackets that extend the handrails in front of the step ladder and hold the rails parallel to each other. The forward extending rails may interfere with the individual's footing while climbing or on the ladder, and therefore introduces additional risk for anyone using a ladder equipped with the device. The horizontal rail is designed too far away from the front face of the ladder making it unusable as a brace when standing on the top rung. Mead's shelf does not appear to have any bins or pass through for tools and hardware. The device is attached to a step ladder by the use of 4 brackets all of which are attached with what appears to be screws, this will void any ladders warranty and structural integrity, deeming it unusable.

An attempt at providing height adjustability of a utility shelf for step stool is disclosed in U.S. Pat. No. 7,383,920-B2 with an expired status to Meeker. The device is a movable handrail and tray to be manufactured as part of a step stool. The movable handrail will only function on the matching step stool and cannot be universally installed on any other type of climbing device.

An attempt at providing handrail for extension ladders to climb and walkthrough the ladder to and from raised landings is disclosed in U.S. Pat. No. 20200248507-A1 in pending status to Moss. The device is a movable handrail designed to only work with extension ladders.

An attempt at providing a handhold on a step ladder is shown in U.S. Pat. No. 9,309,718-B1 in expired status to Matthew. The device disclosed is a step ladder with multiple tool boxes placed at the back and to the sides of the ladder at the top rung height. Matthew's embodiment also includes devices to widen a ladders stance in an attempt to prevent a ladder from tipping over sideways. Shown is a singular attachment meant as a hand hold and appears to be attached using two brackets which are spaced a few inches apart and attached using a pair of fasteners. This would not provide enough strength with the amount of leverage provided with the handrail. Generally any fasteners not factory installed will void a ladders warranty and structural integrity, deeming it unusable.

An attempt at a safety device for stabilizing a user on a step ladder is disclosed in U.S. Pat. No. 20200115959-A1 in pending status to Cohan. The device disclosed is a height adjustable stabilizing rail and harness. The harness is belted around a user's waist and then coupled to a ring on the safety accessory. Shown in FIG. 22 is a single length-adjustable U-shaped elongate member that appears to be extendable. This is physically not possible due to A-frame ladders side rails are not parallel to each other. Another embodiment of said device is only mounted on one side and I feel would not provide enough strength.

An attempt at pipe connector for tubular structure fittings connecting the ends of two tubes in German Pat. No. DE2950742A1 withdrawn by Rose. The fitting connecting the ends of two tubes enables structures such as exhibition stands, shelving etc. to be built up.

An attempt at a safety handrail for stabilizing a user on a step stool is disclosed in German Pat. No. DE202017000453U1 issued to Dominicus. The device disclosed is and extendable handrail, which is mounted on existing ladders or step stools. The handrail is mounted flat against a step ladders or step stools side rail and would interfere with a typical step ladders spreader bars. Said device is only mounted on one side and does not have a tool tray or cross beam.

An attempt at a scaffolding system comprising a plurality of elongate structural tubes and a plurality of node members in European Patent Office No. EP-2141306-A1 withdrawn by Wall.

(F) BRIEF SUMMARY OF THE INVENTION

This invention is revolutionary due to the fact that currently there are only warning labels stating you may lose your balance if you decide to use the top rung or above. I found that use of these forewarned steps is more common than not. It is consistently one of Occupational Health and Safety's top citation. 97.3% of the 500,000 yearly US ladder accidents needing medical treatment happen at anon-occupational setting. Of these, 164,000 was sent to the emergency room and approximately 300 incidents prove to be fatal. The proposed invention converts any step ladder into a semi-platform ladder, providing a supplemental knee brace when standing on the top step and a hand rail for climbing to and from the upper portions of the step ladder. Step ladders are due for something more than just warning labels.

(G) BRIEF DESCRIPTION OF THE SEVERAL VIEWS OF THE DRAWING(S)

In the drawings which illustrate embodiments of the Invention;

FIG. 3 is an isometric view of the tray (4).

FIG. 4 is a back view of the inner rails with the outer rails (2) and tray (4) removed.

(H) DETAILED DESCRIPTION OF THE INVENTION

Figure 1:
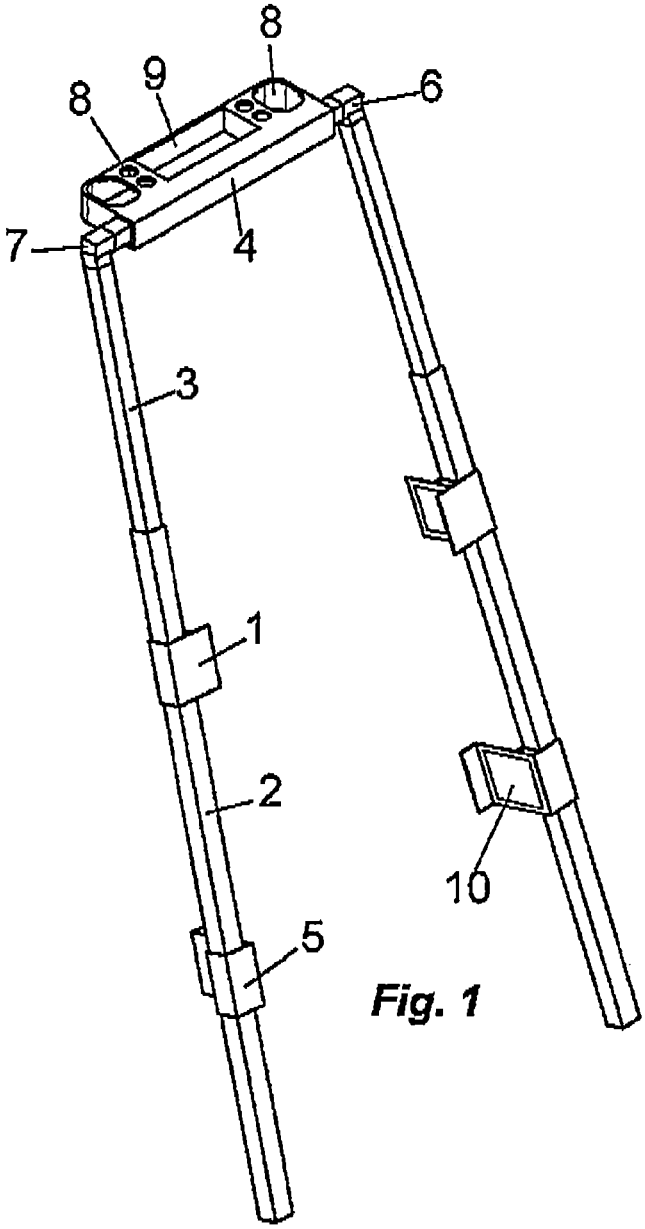
FIG. 1 is an isometric view of an embodiment shown at its middle indexing position.

Step ladders essentially comprises of front side rails, rear support legs, horizontal locking spreader bars, rungs and a top cap. The invention comprises of two upright telescopic rails (2, 3) and a horizontal telescopic beam/tray (4, 14). The upright inner rails (3) extend upwards from the fixed outer rails (2) and latch in place using the Indexing pins (12) at essentially the top and middle of the telescoping travel range when indexed to the indexing holes (1.5). The top indexing position places the tray (4) at the same height as if you were standing on the second to top rung and bracing your knees into the top plate of a ladder. The middle indexing position is essentially 12 inches lower than the top indexing position, giving you a knee brace for standing on the top rung. This advantageously allows you to use 100% of the ladder and eliminates any chance of standing unbraced on any level. With this invention, it makes the upper portion of step ladders safer to use.

The telescoping beam/tray (4, 14) is essential because the two fixed outer rails (2) are connected to the ladders non-parallel "A" shaped front rails. The tray (4) includes a common orifice (13) to receive the two essentially horizontal inner rails (14), tray (4) essentially allows the left and right essentially horizontal inner rails (14) to telescope within its orifice (13), tray (4) includes various pass through openings (8) for holding tools and the like, includes a protruding member (11) to accept a wire handle, includes a container body (9) having a plurality of side walls and bottom joined together.

Figure 2:
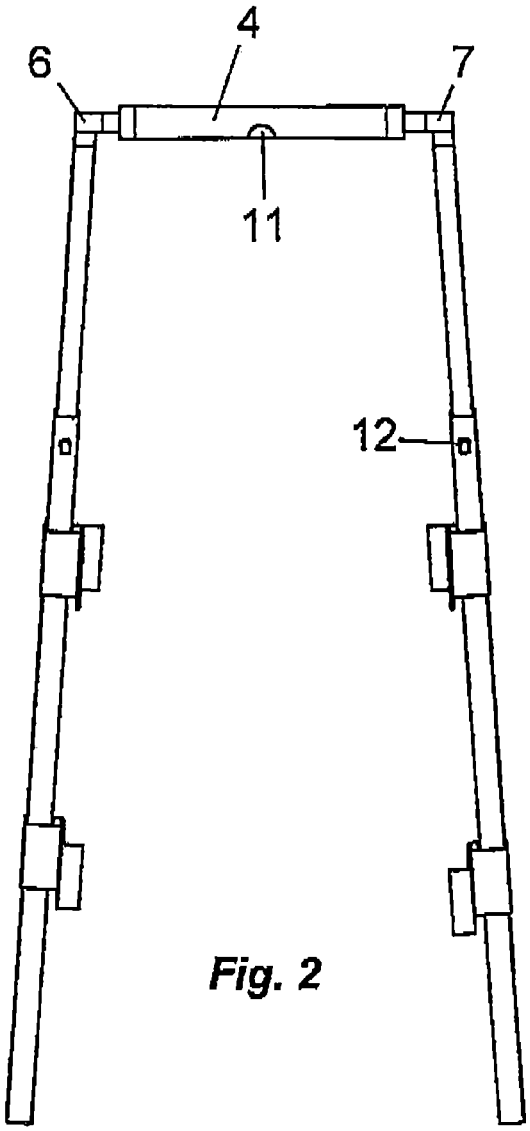
FIG. 2 is a back view of an embodiment shown at its middle indexing position.
Figure 5:
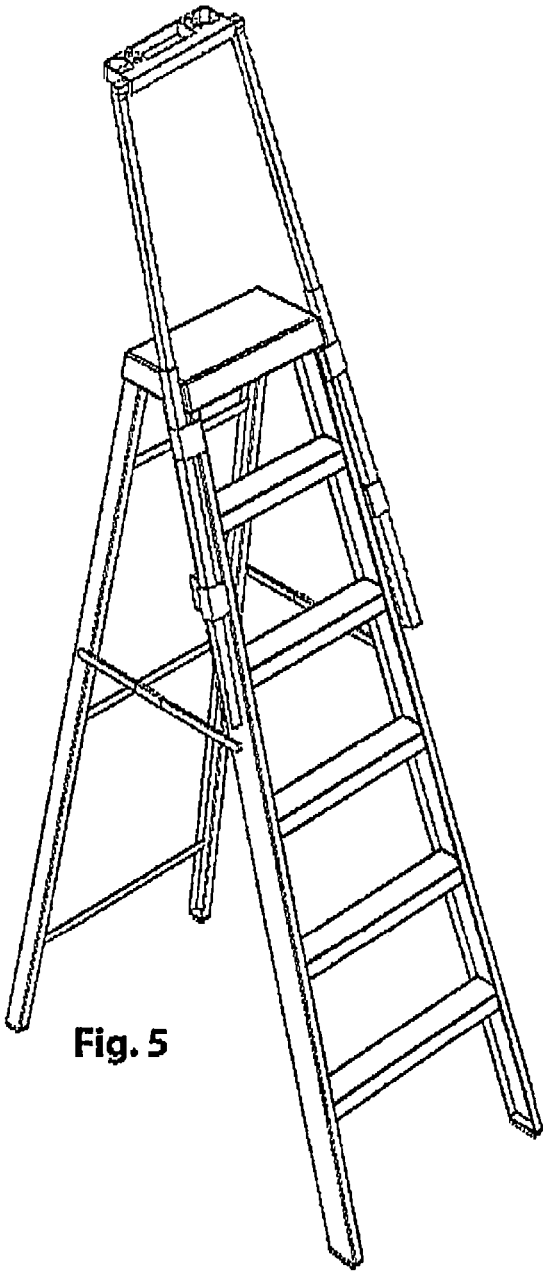
FIG. 5 is an isometric view of the embodiment described in FIGS. 1, 2, 3 and 4 attached to a step ladder.

The embodiment in FIGS. 1, 2 and 4, use of manufactured elbows (6, 7) was desired. These elbows (6, 7) are mirrored copies of each other. They follow the common slopes of standard A-framed step ladders. Their function is to connect the upright inner rails (3) to the horizontal inner rails (14). Another embodiment would be to weld the horizontal rails (14) to the upright inner rails (3).

The upper and lower brackets (1, 5) are attached to the ladder using high strength double sided adhesive tape. The upper brackets (1) have a perpendicular front lap hook and the lower brackets (5) have a perpendicular back lap hook. These hooks combined with the adhesive tape (10) and cantilever action, secures the invention to the ladder without the use of fasteners which would have effect a ladders structural integrity and void its warranty. The upper brackets (1) are fixed to the lower rail (2). In cases where a ladder uses horizontal locking spreader bars on the outer surface where the brackets are installed on, the lower brackets (5) are free to move along the fixed outer rail (2) to allow locating placement that does not interfere with the ladders horizontal locking spreader bars. If the ladder uses inside horizontal locking spreader bars, the lower bracket should be mounted flush to the bottom of the fixed outer rail (2). This makes the invention universal for virtually all step ladders. The upper and lower brackets (1, 5) essentially raise the outer tube from the mounting surface to allow for a ladders horizontal locking spreader bars to clear under the fixed outer rails (2).

The embodiment in FIGS. 5, 6, 7, 8, 9, 10, 12 and 14 show the use of rectangular rails (2, 3). Elbows (6, 7) shown in FIG. 6 are a one piece component combining elbows with the horizontal beams. Embodiment of tray (4) shown in FIG. 7 has an extended slopped face to match the slope of a step ladder and another container body (9) having a plurality of side walls and bottom joined together. Shown in FIG. 8 is a back isometric view of tray and better illustrates a protruding member (11) to accept a wire handle. FIGS. 9 and 10 are isometric views of lower bracket (5) with a clamps (17) embodiment. Shown in FIG. 12 are upper bracket (1) and clamps (17) which are essentially the same as the lower brackets (5) and clamps (17) shown in FIGS. 9 and 10 except they have a hole drilled through and are fixed to the outer rail (2) by a fastened indexing pin (12) shown in FIG. 11.

While preferred embodiments of the invention has been described using specific terms, such description is for illustrative purposes only, and it is to be understood that changes and variations may be made without departing from the intent or scope of the following claims.

The embodiments of the invention in which an exclusive property or privilege is claimed are defined as follows:

1. A safety device and tool tray used on a step ladder comprising front side rails and horizontal locking spreaders bars, the safety device comprising:

a. a pair of essentially upright elongated outer tubes, each with a single fixed upper mounting bracket and a single unfixed lower mounting bracket, said essentially upright elongated outer tubes are mounted on the front side rails, said upper brackets have an essentially perpendicular front lap hook that hooks over the edge of the front side rails, these said upper brackets are fixed to the essentially upright elongated outer tubes, said lower brackets have an essentially perpendicular back lap hook that hooks over the edge of the front side rails, these said lower brackets are mounted after finding a location along the length of said outer tubes that is below the said upper bracket and does not Interfere with the horizontal locking spreader bars of the step ladder, said upper and lower brackets raise the said essentially upright elongated outer tubes from the step ladder front side rails to allow for the horizontal locking spreader bars of the step ladder to clear under the said essentially upright elongated outer tubes, said upper and lower brackets are secured to the step ladder using high strength double sided mounting tape;

b. a pair of essentially upright elongated inner tubes, said elongated inner tubes have a smaller outside dimension than the inside dimension of the elongated outer tubes, when said elongated inner tubes are inserted into respective elongated outer tubes, the elongated inner and elongated outer tubes produce a telescoping tube;

c. a pair of essentially horizontal inner tubes, each one of the pair of essentially horizontal inner tubes is connected to one of the pair of essentially upright elongated inner tubes using one of a pair of Plastic molded elbows to form a essentially right angle assembly, wherein one end of one of the pair of plastic molded elbows is inserted into one of the pair of essentially upright elongated Inner tubes and the other end of the one of the pair of plastic molded elbows is inserted Into one of the pair of essentially horizontal inner tubes;

d. a tool tray, that includes a tunnel to receive the two essentially horizontal inner tubes, said tool tray essentially allows the essentially horizontal inner tubes to telescope within the said tunnel, said tunnel may be open ended or be divided with a wall within, said tool tray includes various pass through openings for holding tools, said tool tray Includes a protruding member to accept a wire handle, said tool tray includes a container body having a plurality of side walls and bottom Joined together;

e. each upright elongated telescoping tube includes an indexing pin or a telescoping tube clamp to stop the essentially upright elongated inner tube in position;

f. both upright elongated telescoping tubes include a matching plurality of indexing hole positions for the said indexing pins to stop in.

2. A step ladder safety device and tool tray as in claim 1 wherein said telescopic tubes may be any shape of tubing including square, round, rectangular, oval, triangular or oblique.

3. A step ladder safety device and tool tray as in claim 1 is secured to the step ladder with structurally approved fasteners, adhesives and clamps.

4. A step ladder safety device and tool tray as in claim 1 may be made from any combination of metals, composites or plastics.

5. A safety device used on a Step ladder comprising front side rails and horizontal locking spreaders bars, the safety device comprising:

a. a pair of essentially upright elongated outer tubes, each with a single fixed upper mounting bracket and a single unfixed lower mounting bracket, said essentially upright elongated outer tubes are mounted on the front side rails, said upper brackets have an essentially perpendicular front lap hook that hooks over the edge of the front side rails, these said upper brackets are fixed to the essentially upright elongated outer tubes, said lower brackets have an essentially perpendicular back lap hook that hooks over the edge of the front side rails, these said lower brackets are mounted after finding a location along the length of said outer tubes that is below the said upper bracket and does not interfere with the horizontal locking spreader bars of the step ladder, said upper and lower brackets raise the said essentially upright elongated outer tubes from the step ladder front side rails to allow for the horizontal locking spreader bars of the step ladder to clear under the said essentially upright elongated outer tubes, said upper and lower brackets are secured to the step ladder using high strength double sided mounting tape;

b. a pair of essentially upright elongated inner tubes, said elongated inner tubes have a smaller outside dimension than the inside dimension of the elongated outer tubes, when said elongated inner tubes are inserted into respective elongated outer tubes, the elongated inner and elongated outer tubes produce a telescoping tube;

c. a pair of essentially horizontal inner tubes, each one of the pair of essentially horizontal inner tubes is connected to one of the pair of essentially upright elongated inner tubes using one of a pair of plastic molded elbows to form a essentially right angle assembly, wherein one end of one of the pair of plastic molded elbows is inserted into one of the pair of essentially upright elongated Inner tubes and the other end of the one of the pair of plastic molded elbows is inserted into one of the pair of essentially horizontal inner tubes;

d. an essentially horizontal outer tube to receive the essentially horizontal inner tubes;

e. each upright elongated telescoping tube includes an indexing pin or a telescoping tube clamp to stop the essentially upright elongated inner tube in position;

f. both upright elongated telescoping tubes include a matching plurality of indexing hole positions for the said indexing pins to stop in.

6. A step ladder safety device as in claim 5 wherein said telescopic tubes may be any shape of tubing including square, round, rectangular, oval, triangular or oblique.

7. A step ladder safety device as in claim 5 is secured to the step ladder with structurally approved fastener's, adhesives and clamps.

8. A step ladder safety device as in claim 5 may be made from any combination of metals, composites or plastics.

9. A safety device and tool tray used on a step ladder comprising front side rails and horizontal locking spreaders bars, the safety device comprising:

a. a pair of essentially upright elongated outer tubes, each with a single fixed upper mounting bracket and a single unfixed lower mounting bracket, said essentially upright elongated outer tubes are mounted on the front side rails, said upper brackets have an essentially perpendicular front lap hook that hooks over the edge of the front side rails, these said upper brackets are fixed to the essentially upright elongated outer tubes, said lower brackets have an essentially perpendicular back lap hook that hooks over the edge of the front side rails, these said lower brackets are mounted after finding a location along the length of said outer tubes that is below the said upper bracket and does not interfere with the horizontal locking spreader bars of the step ladder, said upper and lower brackets raise the said essentially upright elongated outer tubes from the step ladder front side rails to allow for the horizontal locking spreader bars of the step ladder to clear under the said essentially upright elongated outer tubes, said upper and lower brackets are secured to the step ladder using high strength double sided mounting tape;

b. a pair of essentially upright elongated inner tubes, said elongated inner tubes have a smaller outside dimension than the inside dimension of the elongated outer tubes, when said elongated inner tubes are inserted into respective elongated outer tubes, the elongated inner and elongated outer tubes produce a telescoping tube;

c. a left and right essentially horizontal inner tube, each one of these essentially horizontal inner tube is welded to a corresponding left and right essentially upright elongated inner tube to form two essentially right angle assemblies;

d. a tool tray, that includes a tunnel to receive the two essentially horizontal inner tubes, said tool tray essentially allows the essentially horizontal inner tubes to telescope within the said tunnel, said tunnel may be open ended or be divided with a wall within, said tool tray Includes various pass through openings for holding tools, said tool tray includes a protruding member to accept a wire handle, said tool tray includes a container body having a plurality of side walls and bottom joined together;

e. each upright elongated telescoping tube includes an indexing pin or a telescoping tube clamp to stop the essentially upright elongated inner tube in position;

f. both upright elongated telescoping tubes include a matching plurality of indexing hole positions for the said indexing pins to stop in.

10. A step ladder safety device and tool tray as in claim 9 wherein said telescopic tubes may be any shape of tubing including square, round, rectangular, oval, triangular or oblique.

11. A step ladder safety device and tool tray as in claim 9 is secured to the step ladder with structurally approved fasteners, adhesives and clamps.

12. A step ladder safety device and tool tray as in claim 9 may be made from any combination of metals, composites or plastics.

13. A safety device used on a step ladder comprising front side rails and horizontal locking spreaders bars, the safety device comprising:

a. a pair of essentially upright elongated outer tubes, each with a single fixed upper mounting bracket and a single unfixed lower mounting bracket, said essentially upright elongated outer tubes are mounted on the front side rails, said upper brackets have an essentially perpendicular front lap hook that hooks over the edge of the front side rails, these said upper brackets are fixed to the essentially upright elongated outer tubes, said lower brackets have an essentially perpendicular back lap hook that hooks over the edge of the front side rails, these said lower brackets are mounted after finding a location along the length of said outer tubes that is below the said upper bracket and does not interfere with the horizontal locking spreader bars of the step ladder, said upper and lower brackets raise the said essentially upright elongated outer tubes from the step ladder front side rails to allow for the horizontal locking spreader bars of the step ladder to clear under the said essentially upright elongated outer tubes, said upper and lower brackets are secured to the step ladder using high strength double sided mounting tape;

b. a pair of essentially upright elongated inner tubes, said elongated inner tubes have a smaller outside dimension than the inside dimension of the elongated outer tubes, when said elongated inner tubes are inserted into respective elongated outer tubes, the elongated inner and elongated outer tubes produce a telescoping tube;

c. a left and right essentially horizontal inner tube, each one of these essentially horizontal inner tube is welded to a corresponding left and right essentially upright elongated inner tube to form two essentially right angle assemblies;

d. an essentially horizontal outer tube to receive the essentially horizontal inner tubes;

e. each upright elongated telescoping tube includes an indexing pin or a telescoping tube clamp to stop the essentially upright elongated inner tube in position;

f. both upright elongated telescoping tubes include a matching plurality of indexing hole positions for the said indexing pins to stop in.

14. A step ladder safety device as in claim 13 wherein said telescopic tubes may be any shape of tubing including square, round, rectangular, oval, triangular or oblique.

15. A step ladder safety device as in claim 13 is secured to the step ladder with structurally approved fasteners, adhesives and clamps.

16. A step ladder safety device as in claim 13 may be made from any combination of metals, composites or plastics.

* * * * *